US010006263B2

(12) United States Patent
Spencer et al.

(10) Patent No.: US 10,006,263 B2
(45) Date of Patent: Jun. 26, 2018

(54) DOWNHOLE SHIFTING TOOL

(75) Inventors: Max E. Spencer, Houston, TX (US); Philip C. Stevenson, Sugar Land, TX (US); Ruben Martinez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 659 days.

(21) Appl. No.: 14/115,627

(22) PCT Filed: May 7, 2012

(86) PCT No.: PCT/US2012/036809

§ 371 (c)(1),
(2), (4) Date: Mar. 10, 2014

(87) PCT Pub. No.: WO2012/154686

PCT Pub. Date: Nov. 15, 2012

(65) Prior Publication Data

US 2014/0174761 A1 Jun. 26, 2014

Related U.S. Application Data

(60) Provisional application No. 61/483,286, filed on May 6, 2011.

(51) Int. Cl.
*E21B 23/00* (2006.01)
*E21B 23/02* (2006.01)
(Continued)

(52) U.S. Cl.
CPC ..... *E21B 23/00* (2013.01); *E21B 17/1014* (2013.01); *E21B 23/02* (2013.01); *E21B 34/14* (2013.01)

(58) Field of Classification Search
CPC .... E21B 10/322; E21B 10/325; E21B 10/327; E21B 34/14; E21B 23/00
See application file for complete search history.

(56) References Cited

U.S. PATENT DOCUMENTS 1,471,808 A * 10/1923 Russ ..... E21B 10/325 175/227
2,380,022 A 7/1945 Burt
(Continued)

FOREIGN PATENT DOCUMENTS

RU 1778276 A1 11/1992
RU 2281392 C2 8/2006
RU 2319833 C2 3/2008

OTHER PUBLICATIONS

International Search Report for PCT Application Serial No. PCT/US2012/036809 dated Aug. 9, 2012.
(Continued)

*Primary Examiner* — D. Andrews
(74) *Attorney, Agent, or Firm* — Sara K. M. Hinkley

(57) ABSTRACT

A shifting tool for use in shifting axial position of a shiftable element in a well. The tool comprises a linkage mechanism configured to translate an independent axial force into a dedicated radial force applied to expansive elements thereof. Thus, the elements may radially expand into engagement with the shiftable element free of any substantial axial force imparted thereon. As such, a more discretely controllable shifting actuation may be attained, for example, as directed from an oilfield surface. Indeed, real-time intelligent feedback may also be made available through use of such elements in conjunction with the noted linkage mechanism.

14 Claims, 6 Drawing Sheets

(51) Int. Cl.
*E21B 34/14* (2006.01)
*E21B 17/10* (2006.01)

(56) References Cited

U.S. PATENT DOCUMENTS

| | | | | |
|---|---|---|---|---|
| 4,124,070 | A * | 11/1978 | King | E21B 17/003 166/255.1 |
| 4,508,165 | A * | 4/1985 | Foust | E21B 23/03 166/117.5 |
| 4,917,191 | A | 4/1990 | Hopmann et al. | |
| 5,678,633 | A | 10/1997 | Constantine, Jr. | |
| 6,024,173 | A | 2/2000 | Patel et al. | |
| 6,607,044 | B1 | 8/2003 | Eppink et al. | |
| 7,082,994 | B2 | 8/2006 | Frost, Jr. et al. | |
| 7,114,562 | B2 | 10/2006 | Fisseler et al. | |
| 2003/0173076 | A1 | 9/2003 | Sheiretov et al. | |
| 2005/0034874 | A1 | 2/2005 | Guerrero et al. | |
| 2006/0207763 | A1 | 9/2006 | Hofman | |
| 2007/0007016 | A1 * | 1/2007 | Sanderlin | E21B 47/00 166/381 |
| 2008/0083533 | A1 | 4/2008 | Malone et al. | |
| 2009/0071659 | A1 | 3/2009 | Spencer et al. | |

OTHER PUBLICATIONS

Bukalenko, E.I. et al. Neftepromyslovoe oborudovanie. Spravochnik. Moskva, Nedra, 1990, pp. 46-47, drawing 1.15a. (English Abstract).

International Search Report and Written Opinion issued in the related PCT application PCT/US2012/036809 dated Aug. 9, 2012 (8 pages).

International Preliminary Report on patentability issued in the related PCT application PCT/US2012/036809 dated Nov. 12, 2013 (5 pages).

Examination Report issued in the related AU application 2012253672, dated May 6, 2015 (3 pages).

Examination Report issued in the related CA application 2835238, dated Dec. 8, 2014 (3 pages).

Examination Report issued in the related CA application 2835238, dated Oct. 18, 2016 (3 pages).

Extended Search Report issued in the related EP application 12782277.3, dated Sep. 1, 2016 (8 pages).

Office action issued in the related ID application W-00201305179, dated Aug. 19, 2016 (4 pages).

Office action issued in the related MX application MX/a/2013/012985, dated Jan. 29, 2016 (9 pages).

Office action issued in the related MX application MX/a/2013/012985, dated May 17, 2016 (8 pages).

Office action issued in the related MX application MX/a/2013/012985, dated Oct. 4, 2016 (9 pages).

Office action issued in the related MX application MX/a/2013/012985, dated Mar. 3, 2017 (9 pages).

* cited by examiner

DOWNHOLE SHIFTING TOOL

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout its productive life. Ready access to well information as well as well intervention may play critical roles in maximizing the life of the well and total hydrocarbon recovery. Along these lines, information-based or 'smart' management often involves relatively straight forward interventional applications. For example, introduction of a shifting tool so as to start, stop or adjust well production via opening or closing a sliding sleeve or valve may not be an overly-sophisticated maneuver. Nevertheless, continued effective production from the well may be entirely dependent upon such tasks being successfully performed.

While fairly straight-forward, the effectiveness of a shifting tool application may be quite significant, as indicated. In a specific example, consider a well having various isolated production zones. As alluded to above, the overall profile of the well may be monitored on an ongoing basis. Thus, over the life of the well, as certain zones begin to become depleted, produce water or require some form of remediation, an information-based intervention may ensue. More specifically, where a zone of concern is outfitted with a sliding sleeve, an intervention with a shifting tool may take place whereby the tool is directed to the sleeve in order to manipulate a closure thereof. As such, the zone may be closed off in a manner that allows continued production to come from more productive, less contaminant prone, adjacent zones.

The use of a shifting tool as described above generally involves the deployment of the tool to the location of the sleeve or other shiftable feature of the well. This may be accomplished by way of wireline deployment, coiled tubing, tractoring, or any number of conveyance modes, depending on the nature of the well and location of the shiftable feature. Regardless, the tool is outfitted with extension members, generally referred to as 'dogs', which are configured to latch onto the shiftable feature once the tool reaches the downhole location. In many cases, the dogs may be configured to be of a lower profile during deployment to the shiftable feature. Whereas, upon reaching the location, the dogs may be radially expanded for latching onto the shiftable feature such that it may be shifted in one direction or another.

Unfortunately, the effectiveness of the tool faces a variety of limitations associated with the expansion and retraction of the dogs. For example, in a more basic model, the latching features of the tool consist of matching profile areas incorporated into bow or leaf springs of the tool. Thus, the tool traverses the well with a slightly expanded bow portion that ultimately comes into interface with the shiftable feature. Once interlocked, axial forces of the tool are naturally translated outwardly through the bows to a degree. However, aside from the drawback of more limited clearance, between the tool and the well wall, during deployment, the capacity of a bow is also structurally limited. That is, where resistance to shifting is significant, the bow may simply retract without affecting any shifting. Alternatively, bow-type designs may be utilized which avoid collapse once interlocked so long as the shifting is in one direction. That is to say, a collapse of some form must still be built into the tool so as to allow for the disengagement of the tool following shifting without involvement of surface control. As a result, such a tool still lacks assuredness of shifting in both directions.

Therefore, in order to provide more effective multi-directional shifting capacity, the tool may be of an 'intelligent' design where dogs are more affirmatively radially expanded, based when the tool is known to be properly located for shifting. For example, such tools may utilize dogs which are retracted to within the body of the tool during conveyance through the well and then hydraulically expanded outwardly upon reaching the shiftable feature. Unlike bow configurations, such tools are able to provide multi-directional shifting without concern over premature collapse. Unfortunately, however, such tools may be of fairly limited reach.

A greater reach may be provided through the use of dogs which are mechanically driven to expansion. Such is the case where the dogs are retained below a sleeve which may be retracted axially so as to release the dogs radially via spring force upon encountering the shiftable feature. As a practical matter, this results in dogs that are either fully deployed or fully retracted. The ability to centralize or perform tasks with the dogs semi-deployed is lacking in such configurations. Indeed, wells and shiftable features of variable diameters present significant challenges to all types of conventionally available shifting tool options.

SUMMARY

A tool is disclosed which is configured for engagement with a downhole device profile within a well. The tool comprises an actuator, which may be of a piston or perhaps torque screw variety. Additionally, a linkage mechanism is coupled to the actuator and is configured for movement which is responsive to the axial position of the actuator. Thus, a radially expansive element may be provided which is coupled to the linkage mechanism and itself configured for extending from a body of the tool as a result of the indicated movement so as to achieve the noted engagement. Once more, the actuator may also be coupled to a communication mechanism so as to transmit data corresponding to its own axial position relative the body of the tool. Of course, this summary is provided to introduce a selection of concepts that are further described below and is not intended as an aid in limiting the scope of the claimed subject matter.

DETAILED DESCRIPTION

Embodiments are described with reference to certain downhole sleeve shifting applications. For example, utilizing an embodiment of a downhole shifting tool to close off production from a given region of a well is described. However, alternate types of actuations may be undertaken via embodiments of shifting tools as detailed herein. For example, valves such as formation isolation valves may be opened or closed with such a tool. Regardless, embodiments of shifting tools detailed herein include a linkage mechanism located between an axial actuator and a radially expansive element for enhanced shifting capacity of the tool.

Figure 1:
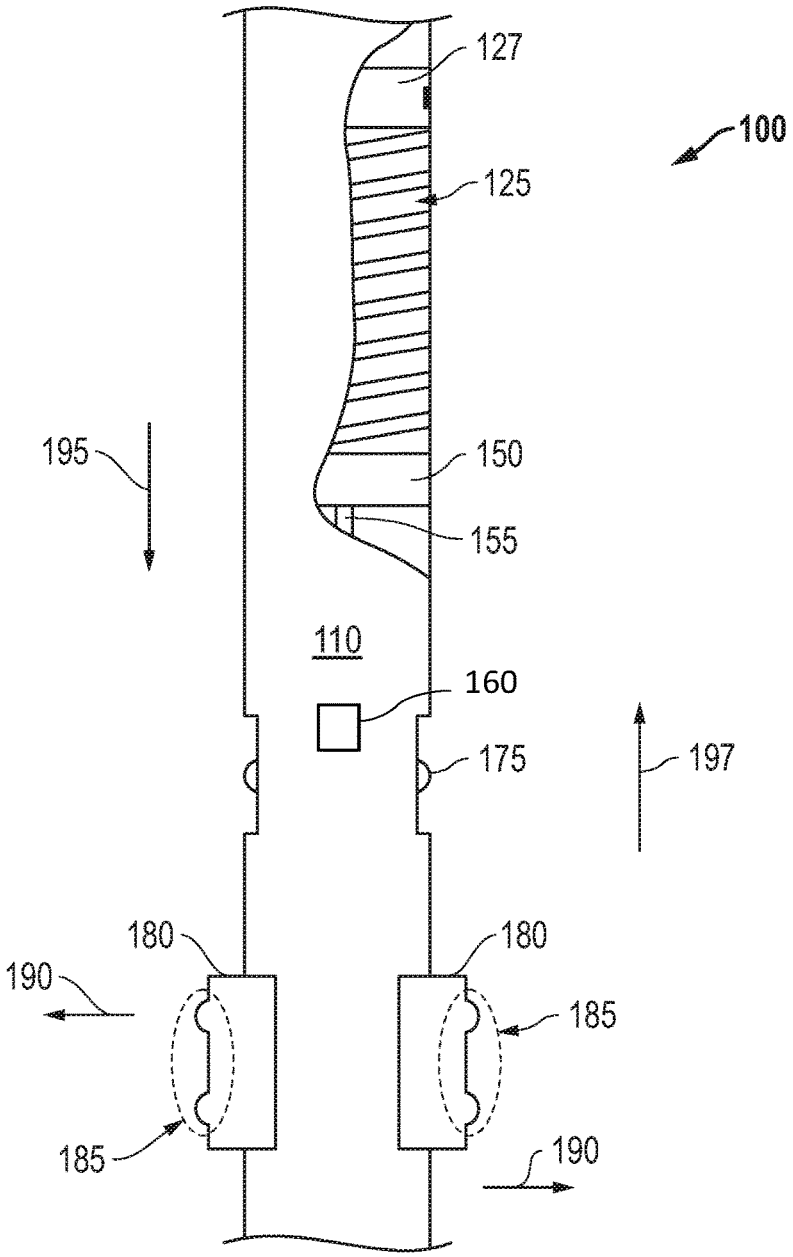
FIG. 1 is a partially sectional front view of an embodiment of a downhole shifting tool.

Referring now to FIG. 1, a partially sectional front view of an embodiment of a downhole shifting tool 100 is depicted. With added reference to FIG. 2, the tool 100 includes radially expansive elements or "dogs" 180, as referenced herein, for engaging a shiftable element downhole in a well 280. For example, note the sliding sleeve 210 of FIG. 2. More specifically, the dogs 180 are configured to engage a shiftable element by way of radial expansion relative a body 110 of the tool 100 (see arrows 190).

Figure 2:
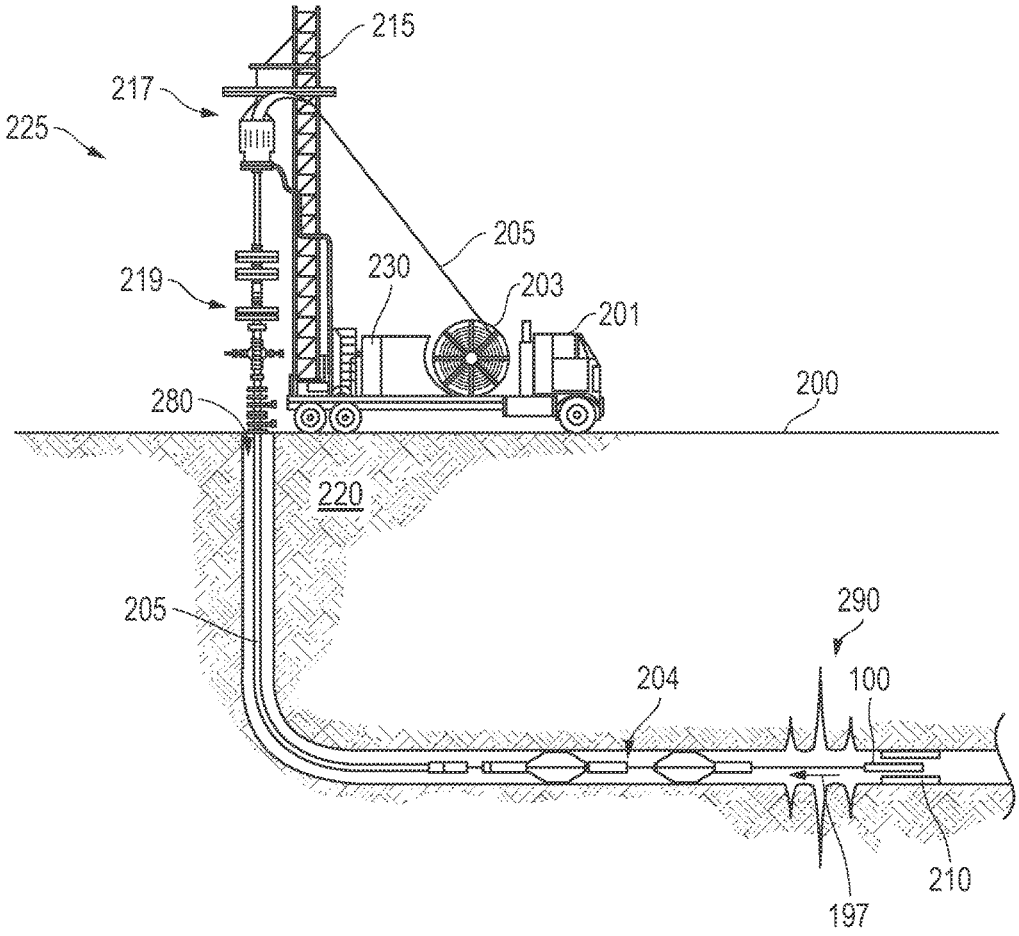
FIG. 2 is an overview of an oilfield with a well accommodating the shifting tool of FIG. 1 therein.
Figure 3A:
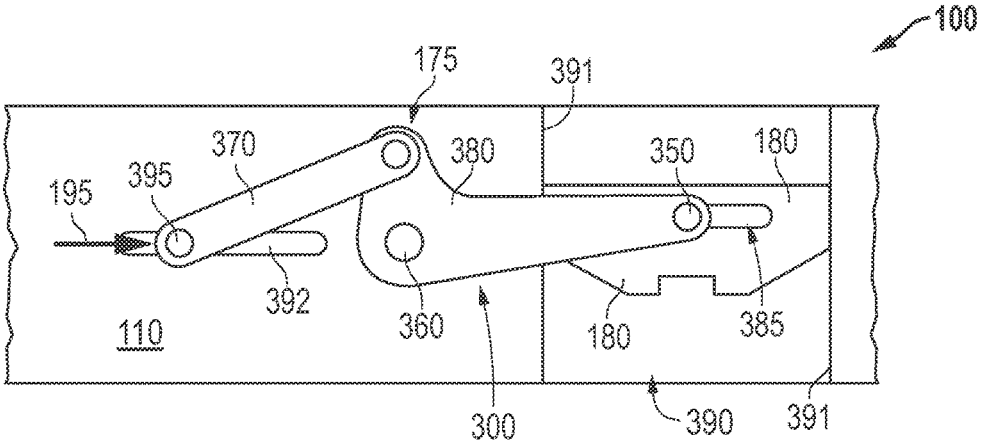
FIG. 3A is a side sectional view of an embodiment of a linkage mechanism retracted to within a body of the shifting tool of FIG. 1.
Figure 3B:
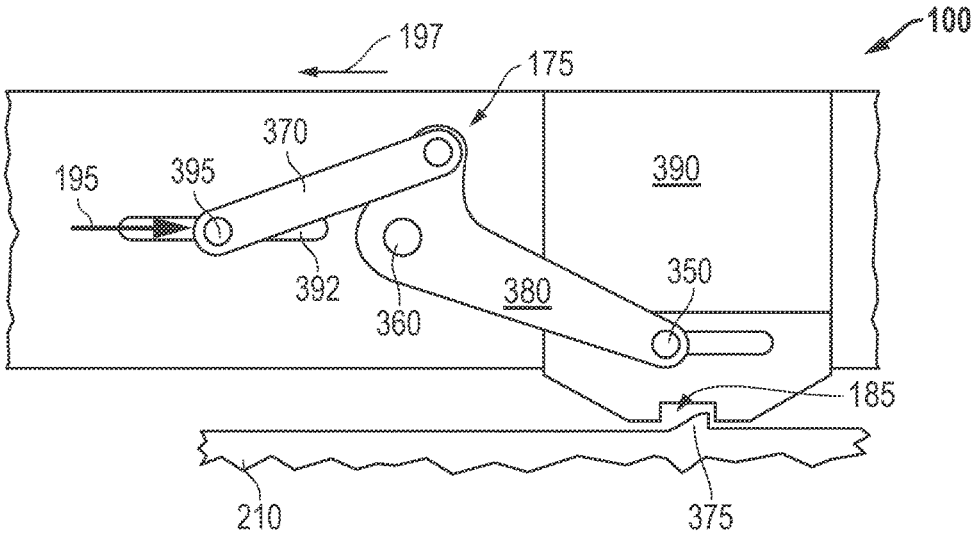
FIG. 3B is a side sectional view of the linkage mechanism of FIG. 3A in a radially expanded position.

With added reference to FIGS. 3A and 3B, the dogs 180 are radially expanded by way of a linkage mechanism 300 located between an actuator 125 and the dogs 180. In the depiction of FIG. 1, a joint 175 of the mechanism 300 is apparent where the tool body 110 includes windows which may allow for less encumbered internal movement. Additionally, the dogs 180 are provided with a matching profile 185 for engagement with a corresponding portion of a shiftable element in a well 280 (such as the sliding sleeve 210 of FIG. 2).

Continuing with reference to FIG. 1, with added reference to FIGS. 3A and 3B, the actuator 125 may include a conventional spring which is coupled to a piston head 150 and rod 155. In the embodiment shown, a driving piston 127 responsive to surface actuation is located at the opposite end of the spring relative the piston head 150. Alternatively, in other embodiments, an accumulator type of hydraulic assembly may be utilized to provide compliance instead of placing a spring in-line with the axial force. Indeed, if either reduced compressible compliance or elimination of intervening parts is sought, the actuator 125 may utilize a more direct mechanical force such as through a rotatable torque screw. Thus, axial force may be applied more directly to the linkage mechanism 300. Regardless, as detailed below, the noted forces applied through the actuator 125 in order to radially expand the elements 180, are linear axial forces imparted through the tool 100 in the direction of arrow 195.

Unlike a conventional bow spring or other similar expansive elements, the radially expansive elements 180 of FIG. 1 impart substantially radial force (see arrow 190) whereas actuator forces are substantially axial (noted arrow 195). Stated another way, the axial forces (arrow 195) are substantially fully converted or 'translated' into radial forces (arrows 190) such that the elements 180 avoid being directly subject to axial forces or further translating such forces back to the actuator 125. Thus, unintended axial push on the elements 180 or may be avoided as the tool 100 is put to use. More specifically, an advancement of the tool 100 may take place with fully retracted elements 180. Upon reaching a target location, an independent axial force may be imparted in the direction of arrow 195 which is substantially translated into a discrete controlled radial expansion of the elements 180 in the direction of arrow 190. Therefore, engagement with a shiftable element may be achieved (e.g. so as to close the sliding sleeve 210 of FIG. 2 in the direction of arrow 197). The tool 100 advantageously provides a substantially one-to-one correspondence between the axial position of the actuator 125 and radial position of the dogs 180, which provides an operator of the tool 100 the ability to measure the position of the dogs 180 during operation of the tool 100.

Referring more specifically now to FIG. 2, an overview of an oilfield 200 is depicted with a well 280 accommodating the shifting tool 100 of FIG. 1 therein. That is, momentarily setting aside the particular internal mechanics of the tool 100, a larger overview of the tool 100 in actual use is shown. In this embodiment, the well 280 traverses a formation 220 and extends into a horizontal section which includes a production region 290. Due to the non-vertical architecture of the well 280, coiled tubing 205 and/or tractor 204 conveyance may be utilized. Of course, the tool 100 may be utilized in wells displaying a variety of different types of architectures and similarly conveyed through a host of different types of conveyances. Indeed, for exemplary purposes, both coiled tubing 205 and tractor 204 conveyances are depicted. However, in other embodiments, one form of conveyance may be utilized in lieu of the other. For example, the tool 100 may be deployed via a wireline cable (with or without a tractor 204), via drill pipe or via a battery powered slickline embodiment, as will be appreciated by those skilled in the art.

Continuing with reference to FIG. 2, surface equipment 225 located at the oilfield 200 may include a mobile coiled tubing truck 201 accommodating a coiled tubing reel 203 and control unit 230 for directing the application. Similarly, a mobile rig 215 is provided for supporting a conventional gooseneck injector 217 for receipt of the noted coiled tubing 205. Thus, the coiled tubing 205 may be driven through standard pressure control equipment 219, as it is advanced toward the production region 290. In embodiments wherein the tool is deployed on a wireline cable, drill pipe, or slickline, suitable surface equipment will be utilized.

In the embodiment shown, the production region 290 may be producing water or some other contaminant, or having some other adverse impact on operations. Thus, the tool 100 may be delivered to the site of the sliding sleeve 210 so as to close off production from the region 290. With added reference to FIG. 1, this may be achieved by delivering the tool 100 to the depicted location and anchoring the tractor 204 in place or otherwise stabilizing the end of the toolstring in place. Independent axial motion of the linkage mechanism 300 of FIGS. 3A and 3B may then be utilized to extend the dogs 180 into engagement with the sleeve 210 (via the matching profile 185). With the engagement securely in place, the sleeve 210 may close off communication with the region 290 as the tool 100 is retracted in the uphole direction (arrow 197).

The described technique of sliding closed a sleeve 210 via a shifting tool 100 may be monitored and directed by way of a control unit 230 located at the surface of the oilfield 200 as alluded to above. However, with added reference to FIGS. 3A and 3B, the tool 100 of embodiments herein, includes a linkage mechanism 300 that allows for real-time tracking and/or "fingerprinting" data which may be used in guiding such operations. For example, the tool 100 may include conventional sensing electronics 160 for monitoring the position of the piston head 150 of FIG. 1 and/or its axial hinged coupling 395 to the linkage mechanism 300. As a result, the dogs 180 may be extended into tracking contact with the wall of the well 280 as the tool 100 is advanced downhole. Indeed, as detailed further below, this type of fingerprinting may be put to more specific use in confirming engagement, shifting, and release of the dogs 180 for a sleeve shifting or other similar downhole application.

With a degree of compliance built into the tool 100, and monitored feedback available via the responsively changing position of the coupling 395, a real-time fingerprinting analysis of the advancing tool 100 may be made available. More specifically, with known well profile information available, an operator at the control unit 230 may examine and confirm data indicative of the dogs 180 tracking the well 280, latching into the sleeve profile, and ultimately being released from engagement once the sleeve 210 is closed. In an embodiment, the operator may direct the disengagement based on the acquired fingerprint data. Alternatively, disengagement may be pre-programmed into the control unit 230 or downhole electronics to take place upon detection of a predetermined load. For example, in an embodiment, a load on the tool 100 exceeding about 5,000 lbs. may be indicative of completed closure of the sleeve 210. As such, dog 180 disengagement and retraction may be in order.

Continuing with added reference to FIG. 1, in addition to real-time location monitoring and/or fingerprint analysis as described above, partial deployment and tracking by the dogs 180 also provides a degree of centralizing capacity to the tool 100. For example, available compliance through a hydraulic or spring actuator 125, allows the tool 100 to navigate known and unknown restrictions as the tool 100 winds its way through the well 280.

Of course, depending on the particular tool embodiment utilized, the above noted compliance may be overridden, for example in conjunction with the described shifting, following centralized tracking. With reference to FIGS. 1, 2, 3A and 3B, this may take place through full compression of the spring of the actuator 125. Thus, compliance may be eliminated to provide a more direct mechanical translation between the actuator 125 and the mechanism 300. Indeed, in an embodiment where the actuator 125 utilizes a spring as opposed to hydraulics, the possibility of changing fluid conditions, leaks, the emergence of air and other fluid based concerns are eliminated. That is to say, while a hydraulic-based actuator 125 may display certain advantages such as control, a spring-based actuator 125 may provide the advantages of both the optional full elimination of compliance in addition to elimination of fluid-based concerns.

Referring now to FIGS. 3A and 3B, the linkage mechanism 300 and internal components of the shifting tool 100 are described in greater detail. More specifically, FIG. 3A reveals a side sectional view of an embodiment of the mechanism 300 retracted to within a body 110 of the tool 100. FIG. 3B, on the other hand reveals the same view of the mechanism 300 in a radially expanded position relative the tool body 110.

With particular reference to FIG. 3A, the linkage mechanism 300 provides a discrete and direct mechanical interface between the independent axial force (arrow 195) supplied by the actuator 125 of FIG. 1 and the radial extension of the dogs 180. Even more specifically, in the embodiment of FIGS. 3A and 3B, the mechanism 300 includes separate arms 370, 380 which are configured to cooperate in translating the independent axial force into a radial force. These arms 370, 380 include a substantially straight or dual-pivot arm 370 and an angled or tri-pivot arm 380. Of course, the arms 370, 380 may take on alternate morphologies. However, the dual-pivot arm 370 may serve as a direct link between two rotatable points (395, 175) whereas the tri-pivot arm 380 of the embodiment shown provides interconnectedness between three rotatable points (175, 360, 350) which do not share linear alignment with one another. Nevertheless, in an alternate embodiment, for example, where greater footspace may be available, the linkage mechanism 300 may be configured with a tri-pivot arm 380 which provides interconnectedness among three rotatable points which are in linear alignment with one another.

Continuing with reference to the above-noted dual-pivot arm 370, it is coupled to the actuator 125 of FIG. 1 via an axial hinged coupling 395 located within a slide body retainer 392. The opposite end of the arm 370 terminates at the above referenced mechanism joint 175. Thus, as axial force is applied in one direction or another, the dual-pivot arm 170 is allowed to rotate relative the coupling 395 and joint 175. In one embodiment, the joint 175 may be configured as a flexure, as opposed to a more conventional rotatable pivot. For example, a small displacement torsion spring may be utilized to allow for rotation in a substantially frictionless manner. Nevertheless, the joint 175 may be considered to contribute to the pivotable-nature of the noted arm 370.

Continuing with reference to FIG. 3A, the tri-pivot arm 380 is rotatably and pivotally anchored about a body pin 360. Thus, this arm 380 is also rotatable about the joint 175 as it moves in concert with the dual-pivot arm 170 thereat. At the same time, however, this arm 380 is also pivotally connected to a slide dog retainer 385 of the depicted dog 180 via a slide connector 350. As such, clockwise rotation relative the body pin 360 translates into downward (or radial extending) movement of the dog 180 from a body cavity 390 as guided by sidewalls 391 thereof. Similarly, counterclockwise rotation of the tri-pivot arm 380 about the body pin 360 translates into upward (or radial retracting) movement of the dog 180 into the body cavity 390.

Continuing now with reference to FIG. 3B, the axial movement applied to the linkage mechanism 300 is shown translating into the noted extension of the depicted dog 180 into engagement with a sliding sleeve 210. More specifically, the matching profile 185 of the dog 180 is brought into engagement with an interlocking feature profile 375 of the sleeve 210. Thus, subsequent movement of the tool 100 in the depicted direction (arrow 197) may be utilized to achieve corresponding movement of the sleeve 210 as detailed hereinabove.

Figure 4A:
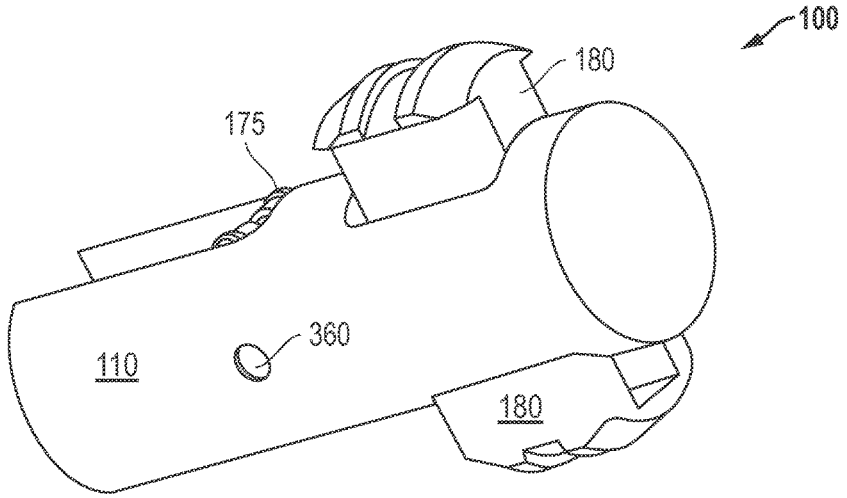
FIG. 4A is a perspective view of the portion of the tool depicted in FIG. 3B revealing radially expanded engagement elements relative the body of the tool.
Figure 4B:
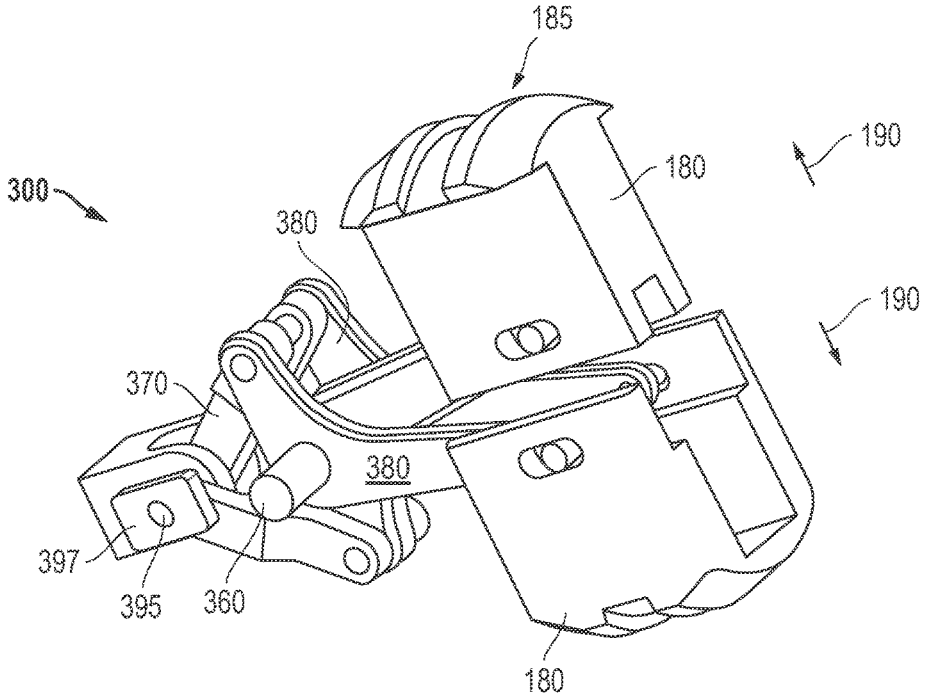
FIG. 4B is an unobstructed perspective view of the linkage mechanism of FIG. 4A.

The depicted embodiment of FIGS. 3A and 3B shows a single dog 180 and linkage mechanism 300. However, as described below with reference to FIGS. 4A and 4B, these features 180, 300 may be multiplied while occupying relatively the same footspace of the tool body 110. So, for example, the tool 100 may be of a two pronged variety with dogs 180 extendable from opposite radial positions of the body 110 as depicted in FIGS. 1, 4A, and 4B. Alternatively, a third or even further additional mechanisms 300 and dogs 180 may be morphologically tailored to fit within the depicted footspace of the body 110. Alternatively, in an embodiment, for example where centralizing is not sought, a single linkage mechanism 300 and dog 180 may be utilized.

Referring now to FIGS. 4A and 4B, perspective views of the portion of the tool 100 depicted in FIGS. 3A and 3B are shown with the dogs 180 in fully expanded positions. More specifically, FIG. 4A shows this portion of the tool 100 with the housing of the main body 110 in place, whereas FIG. 4B reveals the internals of the tool 100, namely the linkage mechanism 300, as it appears with the housing of the body 110 removed. Notably, for added stability and improved stress distribution, the axial hinged coupling 395 may be connected to the housing through a rectangular slider 397 (see FIG. 4B).

With specific reference to FIG. 4A, the dogs 180 are shown in their radially expanded positions as noted. From this vantage point, the joint 175 may be viewed as well as the body pin 360. However, with specific reference to FIG. 4B, it is apparent that the body pin 360 runs through a linkage mechanism 300 that is doubled up. That is to say, two different tri-pivot arms 380 are rotatably coupled to the pin 360. Thus, a single dedicated axial force, via hinged coupling 395, may be translated through two dual-pivot arms 370 to the tri-pivot arms 380 and ultimately to the dogs 180 in a solely radial fashion (see arrows 190).

Figure 5A:
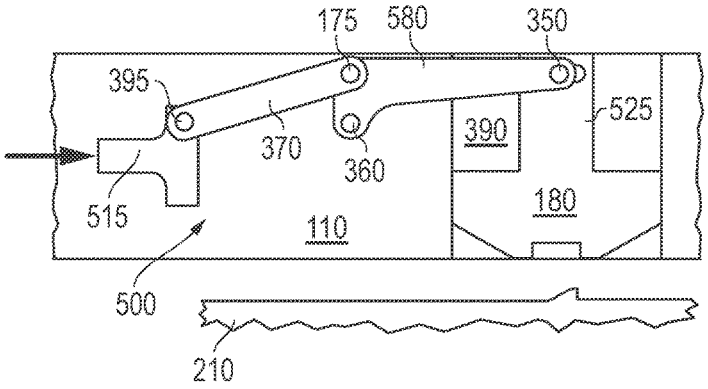
FIG. 5A is a side sectional view of an alternate embodiment of linkage mechanism.
Figure 5B:
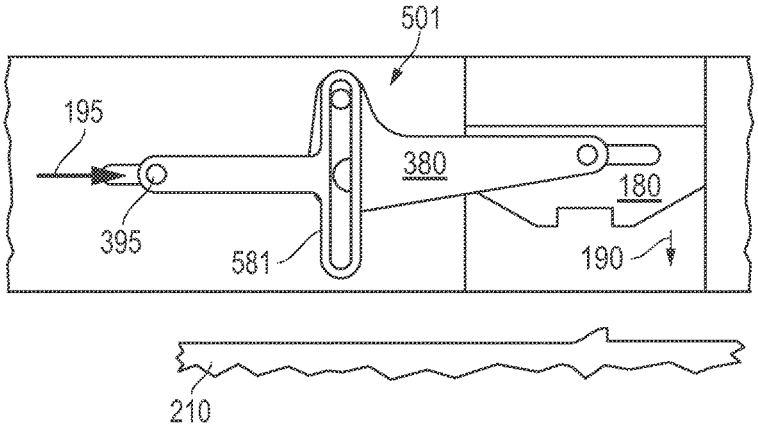
FIG. 5B is a side sectional view of another alternate embodiment of linkage mechanism.
Figure 5C:
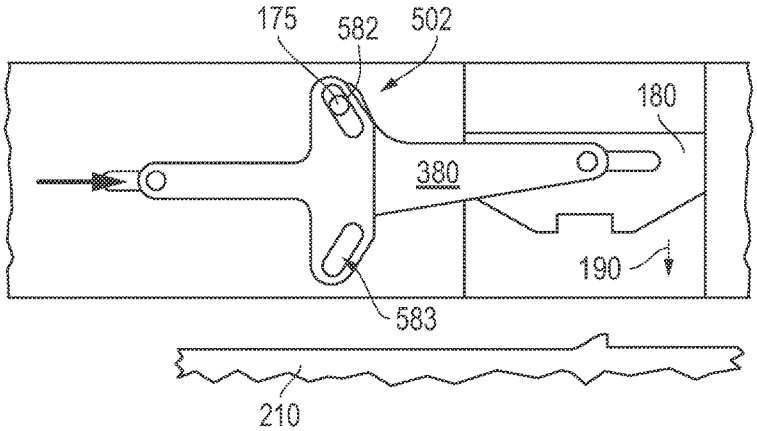
FIG. 5C is a side sectional view of yet another alternate embodiment of linkage mechanism.

Referring now to FIGS. 5A-5C, alternate embodiments of linkage mechanisms 500, 501, 502 are depicted. More specifically, while a radial translation arm remains in the form of a tri-pivot arm 580, 380, it may take on alternate dimensions and/or orientation (see FIG. 5A). Further, the dual-pivot arm 370 may be replaced with an alternate form of an axial translation arm. Namely, slider arms 581, 582 may be utilized which exchange a dual-pivot configuration for guided slide movement of the joint 175 as a manner by which to translate axial forces (arrow 195) to the tri-pivot arm 380. While such alternate configurations may operate largely the same as the embodiment of FIGS. 3A-3B, different dimensional options are effectively presented with the embodiments of FIGS. 5A-5C. So, for example, different ranges of footspace for accommodating multiple linkage mechanisms 500, 501, 502 may be accordingly provided. Thus, the ability to accommodate varying numbers of radially extending dogs 180, beyond one or two, may similarly be provided.

With specific reference to the embodiment of FIG. 5A, added footspace may be provided relative the tool body 110 by way of offsetting the dual-pivot arm 370 relative a central axis. As shown, an offsetting axial element 515 is provided to accommodate the axial hinged coupling 395. This, in turn, results in an offsetting of the body pin 360 and reorienting of the tri-pivot arm 580. Indeed, an extension 525 is provided to the depicted dog 180 to account for the resulting offset position of the slide connector 350. Nevertheless, in spite of the added footspace and offset nature of the mechanism 500, it operates in substantially the same manner as the linkage mechanism 300 depicted in FIGS. 3A-3B. Though, for geometric practicality, shared use of a single offset body pin 360 by additional tri-pivot arms 580 may be avoided.

With specific reference to FIGS. 5B and 5C, the dual-pivot arm 370 of FIG. 5A is replaced with slider arms 581 and 582 that allow for movement of the pivot of the joint 175 therein. In the embodiment of FIG. 5B, the arm 581 is of a single elongated variety such that more than one pivot of different joints 175 may be accommodated by the arm 581 depending on the nature of the construction of the linkage mechanism 501. Alternatively, as shown in the embodiment of FIG. 5C, separate discrete slide portions 583 may be provided for accommodating of separate joint pivots of the mechanism 502. Regardless, each of the configurations uniquely provide for translation of dedicated axial forces into independent radial extension of dogs 180 from the tool body 110 toward a sliding sleeve 210 or other shiftable element (see arrow 190).

Figure 6:
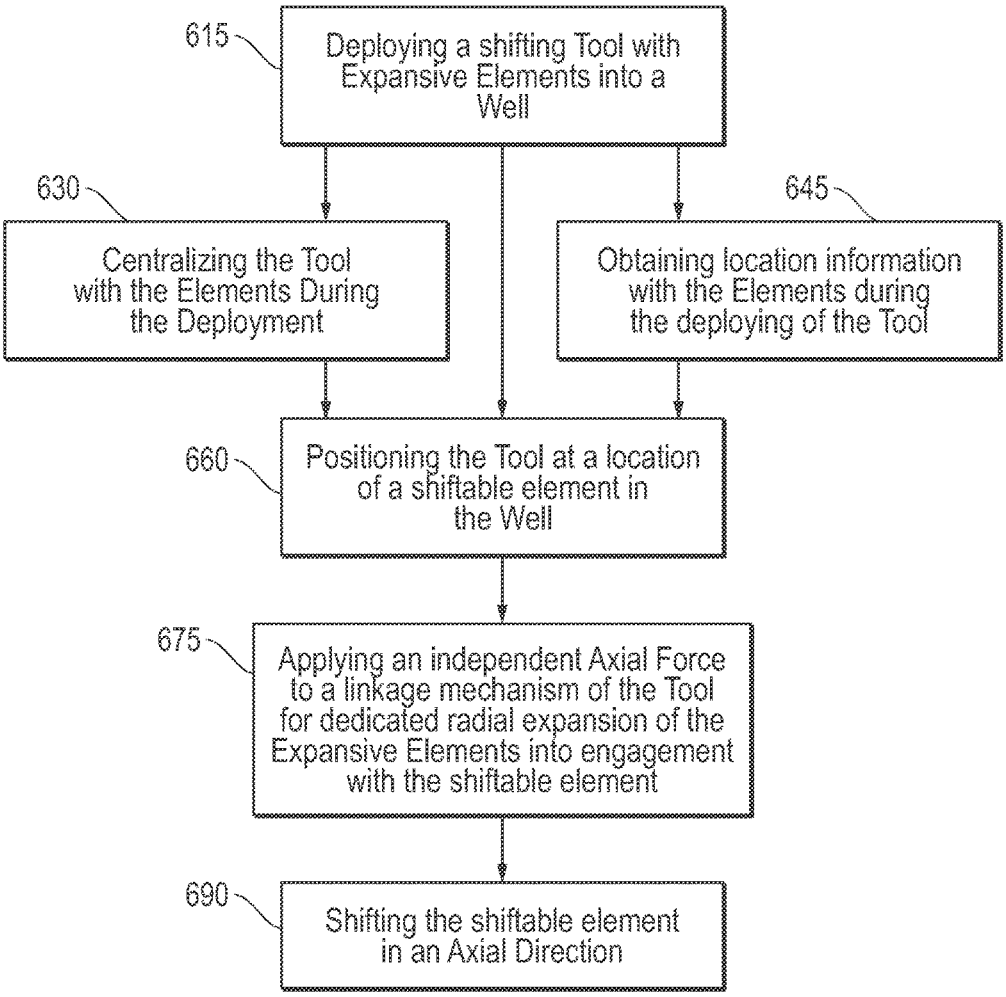
FIG. 6 is a flow-chart summarizing an embodiment of employing a downhole shifting tool in a well.

Referring now to FIG. 6, a flow-chart is shown which summarizes an embodiment of employing a downhole shifting tool in a well. Not only is the shifting tool outfitted with expansive elements, but these elements may be used to centralize the tool (630) and provide location based information (645) during the deployment (615). Additionally, the tool may be located at the position of a shiftable element in the well as indicated at 660, for example a sliding sleeve. Thus, a linkage mechanism of the tool may be utilized in translating an independent axial force to dedicated radial expansion of the expansive elements as indicated at 675. As such, engagement with the shiftable element may be provided so as to allow shifting thereof in an axial direction (see 690).

Embodiments detailed herein provide effective multi-directional shifting capacity, without concern over limited reach, variable well diameters, drag and other common conventional issues. By way of unique linkage mechanisms, for example, utilizing a tri-pivot link, a dedicated axial force may be translated to independent radial extension without undue dimensional restriction to extending engagement elements. Additionally, such embodiments may allow for semi-deployment tasks such as centralizing and real-time feedback. Embodiments disclosed herein advantageously provide a substantially one-to-one correspondence between the axial position of the actuator and radial dog position, as each actuator position provides for a range of motion of the dogs, providing an operator the ability to measure the dog position.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, while conveyances are depicted herein via coiled tubing and/or tractoring, wireline, drill pipe or battery powered slickline embodiments may also be utilized. Additionally, shiftable elements may include downhole features apart from sliding sleeves such as retrievable or formation isolation valves. Furthermore, the foregoing description should not be read as pertaining only to the precise structures described and shown in the accompanying drawings, but rather should be read as consistent with and as support for the following claims, which are to have their fullest and fairest scope.

We claim:

1. A tool configured for engagement of a downhole device profile in a well, the tool comprising:

an axial actuator;

a linkage mechanism connected with said actuator by a coupling for movement responsive to an axial position thereof, and wherein a sensor monitors the position of the axial actuator, the coupling, or both, wherein the linkage mechanism includes a dual-pivot arm that is coupled with the axial actuator by an axial hinged coupling within a sliding body retainer at one end that terminates at a mechanism joint, allowing the dual-pivot arm to rotate relative to the coupling and the mechanism joint; and wherein the linkage mechanism further comprises a tri-pivot arm connected at the mechanism joint with the dual-pivot arm and also pivotally anchored about a body pin below the mechanism joint, allowing the dual-pivot arm to rotate relative to the tri-pivot arm as they move in concert, and wherein the tri-pivot arm is connected with a slide retainer of a radially expansive element via a slide connector; allowing for clockwise rotation relative to the body pin translating into radially extending movement of the expansive element.

2. The tool of claim 1 wherein said actuator is selected from a group consisting of an at least partially compliant actuator and an actuator of substantial non-compliance.

3. The tool of claim 2 wherein said at least partially compliant actuator comprises a mechanical spring.

4. An assembly for positioning at an oilfield for shifting of a downhole device in a well, the assembly comprising:

surface equipment for positioning at a surface of the oilfield adjacent the well;

a tool for the shifting having a linkage mechanism for translating an independent axial force applied thereto into a dedicated radial force in engaging the device, wherein the linkage mechanism includes a dual-pivot arm that is coupled with an axial actuator by an axial hinged coupling within a sliding body retainer at one end terminates at a mechanism joint, allowing the dual-pivot arm to rotate relative to the coupling and the mechanism joint; and wherein the linkage mechanism further comprises a tri-pivot arm connected at the mechanism joint with the dual-pivot arm and also pivotally anchored about a body pin below the mechanism joint, allowing the dual-pivot arm to rotate relative to the tri-pivot arm as they move in concert, and wherein the tri-pivot arm is connected with a slide retainer of a radially expansive element via a slide connector allowing for clockwise rotation relative to the body pin translating into radially extending movement of the expansive element; and a conveyance line coupled to said equipment and said tool, wherein sensing electronics are configured to monitor a position of the linkage mechanism to provide confirmation of engagement with a downhole profile, and wherein the position of the linkage mechanism is communicated through the conveyance line to a controller at surface, allowing real-time tracking of an operation.

5. The assembly of claim 4 wherein said conveyance line comprises at least one device selected from a group consisting of wireline, drill pipe, coiled tubing, a tractor, and slickline.

6. The assembly of claim 5 wherein said conveyance line is the slickline and said tool is battery powered.

7. The assembly of claim 4 wherein the downhole device is selected from a group consisting of a sliding sleeve and a valve.

8. The assembly of claim 7 wherein the downhole device is the valve, and wherein the valve is selected from a group consisting of a retrievable valve and a formation isolation valve.

9. A method of engaging a shiftable element of a downhole device in a well, the method comprising:

deploying a shifting tool to a location of the shiftable element in the well;

applying an independent axial force to a linkage mechanism of the shifting tool and monitoring a position of the linkage mechanism, wherein the linkage mechanism includes a dual-pivot arm that is coupled with an axial actuator by an axial hinged coupling within a sliding body retainer at one end that terminates at a mechanism joint, allowing the dual-pivot arm to rotate relative to the coupling and the mechanism joint; and wherein the linkage mechanism further comprises a tri-pivot arm connected at the mechanism joint with the dual-pivot arm and also pivotally anchored about a body pin below the mechanism joint, allowing the dual-pivot arm to rotate relative to the tri-pivot arm as they move in concert, and wherein the tri-pivot arm is connected with a slide retainer of a radially expansive element via a slide connector; allowing for clockwise rotation relative to the body pin translating into radially extending movement of the expansive element; and translating the independent axial force into a dedicated radially expansive force to engage an expansive element of the tool with the shiftable element, and confirming engagement of the expansive element with the shiftable element using sensing electronics configured to monitor a position of the axial actuator to provide confirmation of engagement with the shiftable element.

10. The method of claim 9 further comprising shifting a position of the shiftable element with the engaged tool.

11. The method of claim 9 further comprising obtaining well location information from the expansive element during said deploying.

12. The method of claim 9 wherein said deploying further comprises advancing the tool to the location in a centralized fashion via the expansive element.

13. The method of claim 12 wherein said advancing comprises obtaining well profile information via the expansive element during said advancing.

14. The method of claim 9, wherein the tri-pivot arm is connected with at least two slide retainers of at least two radially expansive elements via at least two slide connectors.

* * * * *